US006253855B1

(12) United States Patent
Johal et al.

(10) Patent No.: US 6,253,855 B1
(45) Date of Patent: Jul. 3, 2001

(54) INTELLIGENT PRODUCTION RISER

(75) Inventors: Kashmir Singh Johal, Middlesex; Anthony Robert Cousins, London, both of (GB)

(73) Assignee: Mentor Subsea Technology Services, Inc., New Orleans, LA (US)

( * ) Notice: Subject to any disclaimer, the term of this patent is extended or adjusted under 35 U.S.C. 154(b) by 0 days.

(21) Appl. No.: 09/467,438

(22) Filed: Dec. 20, 1999

(30) Foreign Application Priority Data

Jan. 21, 1999 (GB) ..... 9901348

(51) Int. Cl.[7] ..... E21B 17/01
(52) U.S. Cl. ..... 166/367; 405/224.2; 166/345
(58) Field of Search ..... 405/195.1, 224.2; 166/335, 344, 345, 346, 350, 351, 357, 359, 367, 265, 242.1; 138/114, 104, 149

(56) References Cited

U.S. PATENT DOCUMENTS 2,857,931 * 10/1958 Lawton ..... 138/149
3,155,117 * 11/1964 Spillman ..... 138/149
3,349,045 * 10/1967 Knapp et al. ..... 166/350
3,547,161 * 12/1970 Reece et al. ..... 138/114
3,756,268 * 9/1973 Lefever et al. ..... 138/114
4,216,834 * 8/1980 Wardlaw ..... 166/350
4,231,436 * 11/1980 Waller ..... 166/367
5,722,802 * 3/1998 March ..... 138/114
6,035,933 * 3/2000 Khalil et al. ..... 166/357
6,053,249 * 4/2000 Stevenson et al. ..... 166/265

* cited by examiner

*Primary Examiner*—David Bagnell
*Assistant Examiner*—Frederick L. Lagman
(74) *Attorney, Agent, or Firm*—D. Neil LaHaye

(57) ABSTRACT

A production riser that provides the benefits of a slug catcher, riser based gas lift, and multiphase meter in a single device and is suited to both shallow and deep-water oil/gas field developments. The riser is formed from a pipe within a pipe. The inner pipe provides the path for the production fluids. Perforations are provided near the base and top of the inner pipe. The top of the annulus between the pipes is closed and is in fluid communication with a gas supply/compression system via an isolation control valve/choke. The bottom of the annulus is closed. Three sets of pressure and temperature transducer transmitters are installed at the top, center, and base of the riser through the outer pipe wall.

6 Claims, 1 Drawing Sheet

INTELLIGENT PRODUCTION RISER

CROSS REFERENCES TO RELATED APPLICATIONS

Priority from United Kingdom Application Number 9901348.4 filed Jan. 21, 1999 is claimed.

BACKGROUND OF THE INVENTION

1. Field of the Invention

The invention is generally related to risers used in the production of hydrocarbons and more particularly to the use of production risers and associated equipment in relation to handling slugs, riser base gas lift and metering flows.

2. General Background

In the production of oil and gas, slugging can occur in multiphase production flowlines as a result of any of the following mechanisms: hydrodynamic slugging; terrain induced slugging; production flow rate changes; or severe slugging at the base of the riser. Slugging is the phenomenon of fluids flow instability.

Hydrodynamic slugging is caused by the nature of the physical property differences between the highly compressible gas phase and relatively incompressible liquid phase being transported together in a flowline. The nature, size, and frequency of slugs are statistically dependent and, therefore, 99-percentile slug size is used to size slug catchers, for example.

Terrain induced slugging occurs when liquid is held up in the dips of the flowline due to reduced production rates and the profile of the terrain. Also, severe slugging can result upon a production restart or rate increase.

Production flow rate changes can increase the liquid hold up in the flowline when production flow rate is reduced, which is then swept out as a large slug upon flow rate increase.

Severe slugging can be considered as a special case of terrain induced slugging and occurs when the flowline inclines downwards before the vertical riser and the flow regime is segregated.

Conventional systems use large and costly slug catchers on the receiving facilities to mitigate slugs, stabilize flow, and improve separation efficiency. The space on the receiving facility (offshore platform) is tight and at a premium, along with operational problems such as control trips resulting from slugs and gas surges that cause loss of production and hence revenue.

A riser based gas lift system is used to complement slug catchers to mitigate slugs, especially during systems start up. Riser based gas lift systems are generally complicated and costly. They require an unwanted degree of systems complexity, both at the subsea location (e.g., diffusers) and topsides on the platform (e.g., chemical inhibition system, valving, heating, power, etc.).

Existing multiphase meters are highly complex devices that use sophisticated mechanisms such as gamma radiation and mixers, as well as power and data capture and transmission equipment, all of which limit accuracy (+/−10%), reliability, and increase costs.

It can be seen that the current state of the art leaves a need for equipment that is capable of handling slugging with reduced cost and complexity.

SUMMARY OF THE INVENTION

The invention addresses the above need. What is provided is a production riser that provides the benefits of a slug catcher, riser based gas lift, and multiphase meter in a single device and is suited to both shallow and deep-water oil/gas field developments. The riser is formed from a pipe within a pipe. The inner pipe provides the path for the production fluids. Perforations are provided near the base and top of the inner pipe. The top and bottom of the annulus between the pipes is closed and is in fluid communication with a gas supply/compression system via a surface mounted isolation control valve/choke. Three sets of pressure and temperature transducer transmitters are installed at the top, center, and is base of the riser through the outer pipe wall.

BRIEF DESCRIPTION OF THE DRAWINGS

For a further understanding of the nature and objects of the present invention reference should be made to the following description, taken in conjunction with the accompanying drawing in which like parts are given like reference numerals, and wherein.

DETAILED DESCRIPTION OF THE PREFERRED EMBODIMENT

Figure 1:
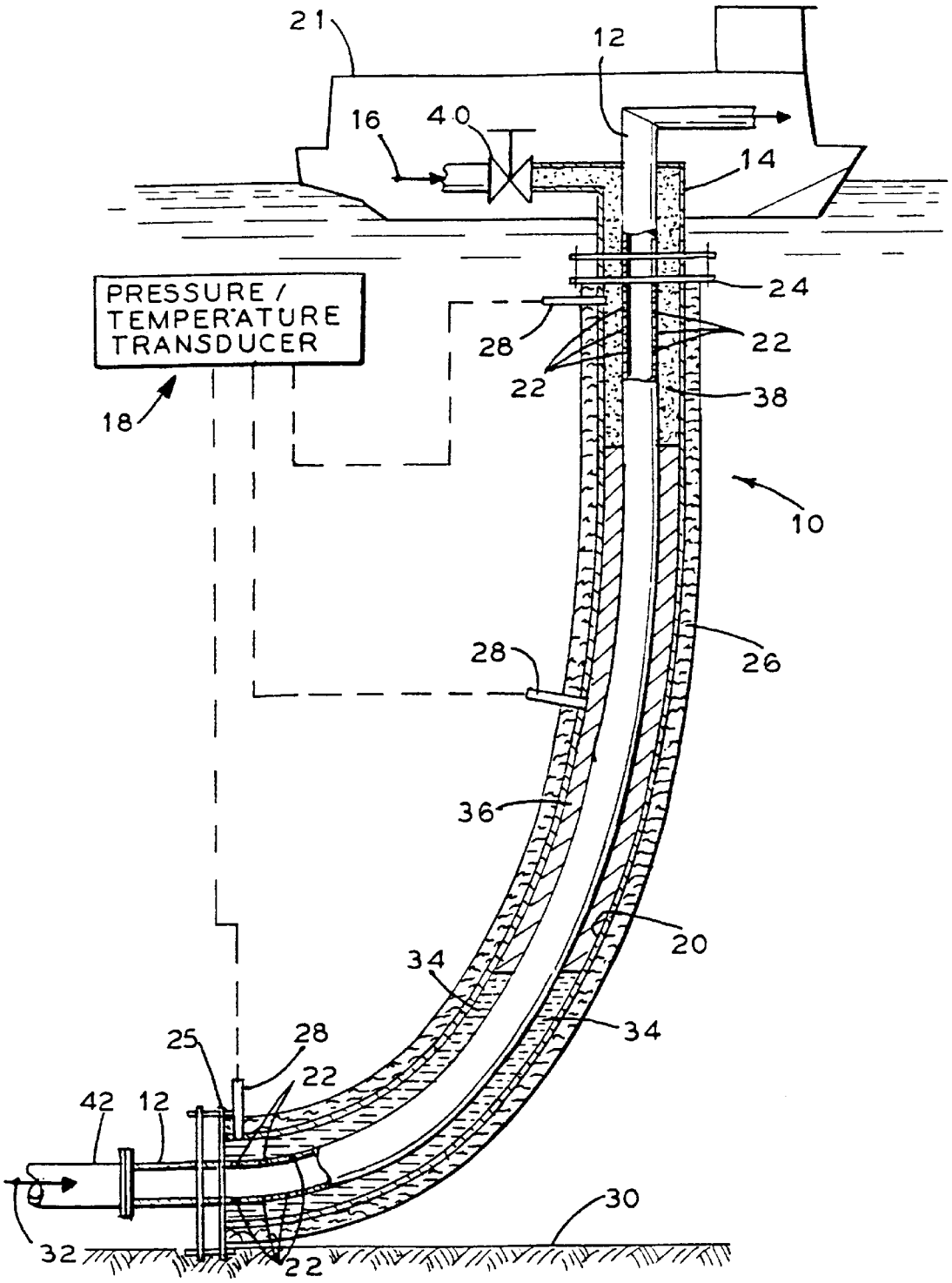
FIG. 1 is a side sectional view of the invention.

Referring to the drawings, it is seen in FIG. 1 that the invention is generally indicated by the numeral 10. The production riser 10 is generally comprised of an inner pipe 12, an outer pipe 14, a gas supply 16, and means 18 for monitoring pressure and temperature in the annulus between the pipes 12 and 14.

The inner pipe 12 is preferably formed from production pipe normally used to produce oil and gas. The inner pipe 12 is received within the outer pipe 14 so as to be concentric therewith, and thus defines an annulus 20 between the pipes. The top and bottom of the annulus between the pipes is closed to the ambient pressure and is in fluid communication with a gas supply/compression system via a surface mounted isolation control valve/choke. The gas supply is provided on the topside facility 21, which may be a floating offshore platform or a fixed platform. A plurality of perforations 22 is provided adjacent the base and upper portion of the inner pipe 12 such that the interior of the inner pipe 12 and the annulus 20 are in fluid communication.

The outer pipe 14 is formed from any pipe suitable for the pressures that are encountered during production operations and the offshore environment.

Inner and outer pipes 12 and 14 are held in concentric relationship by a connector 24 at the upper end of the pipes and a blind flange 25 at the lower end of the pipes.

A layer of insulation 26 may be provided around the outer pipe 14. Any insulation suitable for use underwater may be used.

Means 18 for monitoring the temperature and pressure in the annulus 20 is provided in the form of a plurality of transducers 28 located at the upper, middle, and lower portions of the annulus.

In operation, the lower end of the production riser 10 is positioned at the seafloor 30 and attached to a production flow line 42 so as to be in fluid communication therewith. This allows for the flow of oil and/or gas, which flow is indicated by arrow 32, into the inner pipe 12. The production fluids entering the inner pipe also enter the annulus 20 through the perforations 22. The inner pipe 12 is illustrated as having the same diameter as the production flow line 42. It is preferable that the inner pipe 12 have an inner diameter that is at least equal to or slightly larger than the production flow line 42.

The production fluids separate naturally in the annulus according to the weight of the fluid because there is no liquid flow through the annulus. Water, indicated by numeral 34, collects at the bottom. Oil, indicated by numeral 36, floats on top of the water 34. Gas, indicated by numeral 38, collects above the oil 36. The amount of each fluid is directly related to the ratio of gas to liquid in the production fluid flowing through the inner pipe 12. Any minor difference in the relative quantities of fluids in the annulus and inner pipe is related to the additional pressure head loss in the inner pipe due to flow and can be easily corrected for. Hydrostatic equilibrium prevents flooding of the annulus.

During startup operations when the inner pipe 12 is full of liquid, gas is forced into the annulus 20 through the use of gas supply 16. Gas is injected through valve 40 into the annulus 20. The gas flows down the annulus and into the inner pipe through the perforations 22. The gas serves to temporarily reduce the liquid density as the gas moves upward through the liquid. This allows the flow of liquid up the inner pipe to begin with little or no mechanical assistance. Gas injection is terminated by closing valve 40 after a stable production level is reached.

During steady equilibrium production conditions, the pressure conditions across the perforations at the base and upper portion of the inner pipe are similar. Under non-ideal conditions, such as when a slug enters the inner pipe, there is a degree of production flow rate instability in which the pressure across the base and upper perforations will differ. Physical fluid hydrostatics causes a natural attempt to equalize the pressure differential by a small circulation of fluids between the inner pipe and annulus.

As a liquid slug enters the inner pipe and begins to travel towards the top, a pressure differential develops across the perforations at the base of the inner pipe since the liquid content in the inner pipe has increased. Thus, the pressure head in the inner pipe is greater than in the annulus. This creates a liquid flow into the annulus, which slows liquid flow in the inner pipe. As this process continues, the additional liquid in the annulus compresses the annulus gas 38. This creates a pressure differential across the perforation holes at the top of the inner pipe, which results in gas flowing from the annulus into the inner pipe. This flow of gas will mix and break up the liquid slug travelling up the inner pipe when the slug reaches the perforations at the upper portion of the inner pipe. A similar process occurs in reverse when a gas slug enters the base of the inner pipe and travels toward the top.

The number and size of the perforations 22 are selected to handle a range of operating conditions. The perforations are preferably sized to handle the worst liquid slug size, frequency and gas surge functions expected.

The pressure and temperature transducers are used to locate the interfaces of both gas and oil, and oil and water (if present) and predict gas-to-liquid ratio and water cut of the production fluids. The flow rates of the production fluids are calculated from the liquid hold up and a mathematical model of multiphase production flows. Under normal production conditions, the movement of these interfaces will be negligible as a result of attaining equilibrium conditions. However, they will change during slugging conditions. The loss of metering accuracy due to interface movement is negligible, especially for deepwater developments. For example, a one-meter movement of liquid surface in one thousand meters of water depth is only one tenth of one percent. The interface movement changes are generally slow whereas the data acquisition from the transducers will be of much shorter duration.

Severe slugging as a result of the differing levels in the flow line and between the flow line and the inner pipe generally causes liquid slugs that are no greater than the volume of the inner pipe. Therefore, the volume of the annulus is preferably equivalent to the inner pipe volume. Multiphase slugging analysis will provide the sizing requirements for the annulus volume.

Further, this invention allows the following:

Pigging operations to be performed.

The system to be economically retro-fitted from the receiving facilities vessel or platform thus requiring no additional vessels for retrofit/replacement.

A facility for a riser base gas lift by isolating the top perforations by means of a sliding sleeve.

The design shown applies for a steel catenary or a rigid riser system but an alternative design for the riser is necessary in the application for flexible risers of compliant wave type. A possible alternative could be an external piggy back riser to represent the annulus pipe-in-pipe riser volume externally.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed is:

1. A hydrocarbon production riser, comprising:

a. an outer pipe;

b. an inner pipe received within and concentric with said outer pipe to define an annulus between said pipes, said inner pipe having a plurality of perforations provided adjacent each end of said inner pipe; and c. means for selectively supplying gas into the upper portion of the annulus defined between said inner and outer pipes.

2. The hydrocarbon production riser of claim 1, wherein the upper portion of the annulus is closed to the ambient pressure and the lower portion of the annulus is blocked by a blind flange.

3. The hydrocarbon production riser of claim 1, further comprising a layer of insulation provided around said outer pipe.

4. The hydrocarbon production riser of claim 1, wherein the volume of the annulus defined between said inner and outer pipes is approximately equal to the interior volume of said inner pipe.

5. A hydrocarbon production riser, comprising:

a. an outer pipe;

b. an inner pipe received within and concentric with said outer pipe to define an annulus between said pipes, said inner pipe having a plurality of perforations provided adjacent each end of said inner pipe, with the upper portion of the annulus being closed to the ambient pressure and the lower portion of the annulus being blocked by a blind flange, and the annulus having a volume approximately equal to or greater than the interior volume of said inner pipe; and c. means for selectively supplying gas into the upper portion of the annulus defined between said inner and outer pipes.

6. The hydrocarbon production riser of claim 5, further comprising a layer of insulation provided around said outer pipe.

* * * * *